United States Patent [19]

Wider

[11] Patent Number: 4,601,531

[45] Date of Patent: Jul. 22, 1986

[54] ELECTRICAL CONNECTOR FOR LARGE-CURRENT CIRCUITS

[75] Inventor: Hans W. Wider, Detmold, Fed. Rep. of Germany

[73] Assignee: C. A. Weidmueller GmbH & Co., Detmold, Fed. Rep. of Germany

[21] Appl. No.: 704,295

[22] Filed: Feb. 22, 1985

[30] Foreign Application Priority Data

Mar. 3, 1984 [DE] Fed. Rep. of Germany ..... 3408006

[51] Int. Cl.[4] ..... H01R 4/36

[52] U.S. Cl. ..... 339/272 R; 339/198 R

[58] Field of Search ..... 339/198 R, 198 G, 198 GA, 339/198 N, 272 R, 272 A, 244 R, 248 R, 249 A

[56] References Cited

U.S. PATENT DOCUMENTS 3,496,521 2/1970 Hohorst ..... 339/272 R

FOREIGN PATENT DOCUMENTS 2039054 9/1971 Fed. Rep. of Germany .
2051781 4/1972 Fed. Rep. of Germany ... 339/272 R
2352432 4/1975 Fed. Rep. of Germany ... 339/272 R

*Primary Examiner*—Neil Abrams
*Attorney, Agent, or Firm*—Michael J. Striker

[57] ABSTRACT

An electrical connector includes a clamping device having a clamping member for receiving a conductor and a clamping bolt, and a busbar. The end of the busbar is formed with a bend-over portion which is insertable into the clamping device together with the end of the conductor, overlapping that bend-over portion, from the same side of the clamping device.

5 Claims, 1 Drawing Figure

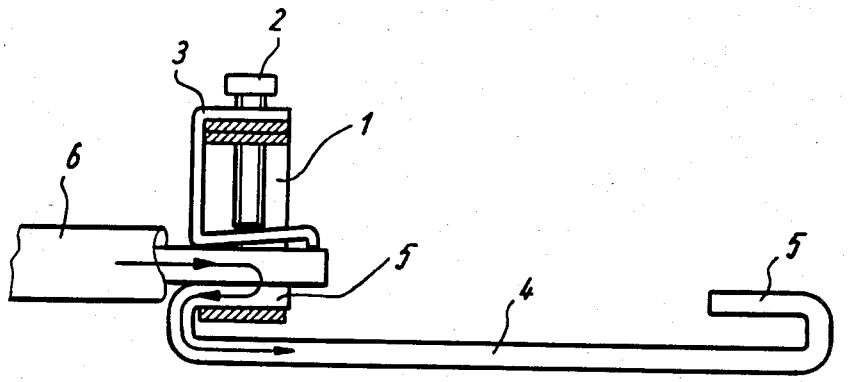
2
3
1
6
5
4
5

ELECTRICAL CONNECTOR FOR LARGE-CURRENT CIRCUITS

BACKGROUND OF THE INVENTION

The present invention relates to an electrical connector, particularly for large-current circuit terminals.

Electrical connectors of the type under consideration include a busbar, a clamping member defining a conductor-receiver, and a clamping organ.

German patent publications DE-AS No. 2,039,054 and DE-AS No. 2,159,739 disclose electrical connector in which a busbar is inserted into the clamping member from one side thereof whereas a conductor to be connected to the busbar is inserted into the clamping member from the other so-called conductor-plug-in side. For the actuation of the connector, a clamping organ, usually a clamping bolt, provided with a pressing piece and contacting with the end of the busbar, is positioned against a conductor inside the clamping member which surrounds the conductor.

It has been, however, discovered that when conductors of large cross-sections or diameters are to be handled the insertion of the conductor into the clamping member has created some problems particularly when the conductor has been many times curved or bent and had to be straightened.

With such electrical connectors the operation with alternating current, particularly in a greater current range, has been also problematic, and in case that the clamping member is formed of ferromagnetic material, for example of steel, such a connector is a magnetically closed system. Considerable induction currents can occur in the connector, which currents cause heating of the clamping member and also negatively affect current-flow resistance. There is a necessity to use, for example paramagnetic materials to avoid the above problems. Inductive effects can be thereby reduced but not totally eliminated. The utilization of such materials leads to higher manufacturing costs and at the same time to decrease in mechanical safety. It has been also conceivable for clamping conductors of greater diameters to apply to the clamping system considerable clamping forces and maintain such forces. Furthermore, the utilization of the clamping members, for example of steel, is also very advantageous.

SUMMARY OF THE INVENTION

It is an object of the present invention to provide an improved electrical connector.

It is another object of this invention to provide a connector which is easy to handle, and in which an easy insertion of a conductor into the clamping device would be ensured and at the same time overheating of the clamping device in operation with alternating current would be prevented.

These and other objects of the invention are attained by an electrical connector, particularly for large-current circuit terminals, comprising a busbar; and clamping means receiving a conductor to be connected to the busbar and including a clamping member and a clamping organ, said clamping member surrounding an end of said conductor and an end of the busbar, said clamping organ being actuated to connect the end of the conductor to the end of the busbar, said clamping means having a conductor plug-in side, the end of the busbar being formed with a bend-over portion extended rearwardly of the busbar, said end of the conductor and said bend-over portion being insertable into said clamping means only from the plug-in side thereof.

The provision of the busbar or current rail with the bend-over, rearwardly directed portion solves not only the problem of a controlled insertion of the conductors to be connected into the clamping device but also the problem of handling of the device and the problem of heating of the same. Due to the present invention the electric current, which flows through the conductor at the plug-in side of the clamping device, will emerge from the clamping device at the same side thereof and not as before, at another side of the clamping device. This results in the compensation for an electro-magnetic action on the clamping system. If ferromagnetic materials are utilized no electromagnetic induction currents would result. The clamping device itself during the operation with alternating current of relatively great intensity is subjected to substantially reduced heating and has a substantially decreased current-flow resistance. Finally the electrical connector of this invention can have overall much smaller dimensions than conventional connectors, or even if designed with the same dimensions as those of conventional connectors this connector can handle higher electrical loads.

The busbar has two ends, each of which may be provided with such bend-over portion.

The busbar, the clamping member and the clamping organ may be all made of steel. The utilization of ferromagnetic materials, and specifically steel, ensures high mechanical stability and offers a possibility of applying high clamping forces for a longer period of time.

The manipulation and handling of the connector of the present invention are very easy. Since the end of the conductor and the bend-over end of the busbar are to be inserted into the clamping means from the same side hereof, which is the plug-in side, the conductor end, upon the actuation device, is first placed over the end of the busbar and the clamping device is then placed so as to surround these two overlapping ends, and the clamping action by actuating of the clamping organ follows. Thus the contact area is always accessible to an operator during the assembly.

The clamping organ may be a clamping bolt inserted into said clamping member.

The clamping means may further include a pressing element, said bolt pressing said pressing element against the end of the conductor and the bend-over portion to connect them to each other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawing illustrates a connector of the invention, partially in section.

DETAILED DESCRIPTION OF THE PREFERRED EMBODIMENT

Referring now to the drawing in detail, the electrical connector comprises a clamping body or member 1 which is formed in the exemplified embodiment as a yoke closed by respective bent portions and made of steel. A clamping organ formed by a clamping bolt 2 is screwed into the clamping member 1 and extends into the interior of the clamping member. The clamping action of the clamping bolt is enhanced via a pressing element 3.

A current rail or busbar 4 which is another conductor, to which a conductor 6 is to be connected, has an end cooperating with the clamping member 1. This end is formed with a fold or bend-over portion 5. This bend-over portion 5 is bent over and has its end directed rearwardly of the busbar 4. Two bend-over portions 5 at both ends of the busbar 4 can be provided. The bend-over portion can be actually made by bending the end of the busbar rearwardly, and also by connecting of a respective separately-formed angle to the straight-line, non-bent busbar.

The clamping member 1 surrounding the end of conductor 6 and the bend-over portion 5 of the busbar 4 simultaneously serves as a receiver for the conductor 6 to be connected to the busbar. Conductor 6 is always inserted into the clamping member 1 from a predetermined side which is a so-called conductor plug-in side. The arrangement is such that the bend-over portion 5 of the busbar 4, and only the bend-over portion can be inserted into the clamping device from the conductor plug-in side. With this construction the flow of the current, upon the actuation of the electrical connector, is as shown by arrows in the drawing. As the drawing shows due to invention the current which flows from the conductor 6 to the busbar 4 flows out exactly at the same side at which the current flows in.

As can be clearly understood the handling of the connector during the actuation thereof is extremely easy. It is not necessary to straighten a conductor before it has been inserted into the connector. For assembling, the end of the conductor to be connected is merely laid onto the bend-over portion 5 of the busbar 4 and then both portions together practically overlie the busbar 4, and the clamping member 1 with clamping bolt 2 and pressing element 3 thereon is shifted to surround these both portions, and the clamping is performed thereafter.

There is no danger that induction currents followed with a respective heating of the clamping member and a reduction in current-flow resistance would occur when all the elements of the clamping system are made of steel. There is also no necessity to apply higher clamping forces to the clamping device.

Inasmuch as in many instances of use the second end of the busbar is formed in the same manner as an electrical connector this second end can be also provided with a bend-over portion 5 which would be inserted in the same fashion into a further clamping member 1. The utilization of such an electrical connector is not limited to large-current clamps or terminals, particularly to large-current series terminals. The problems occurring in the conventional connectors are also overcome when the connector of the invention is to be utilized in fuse-carriers.

The bending of the busbars can take place when the latter are manufactured. The bend-over portions of busbars can be formed with safety catches, for example in the form of corrugations on the surface of the burbar or, in the form of clamp hooks on the end face of the busbar.

It will be understood that each of the elements described above, or two or more together, may also find a useful application in other types of electrical connectors differing from the types described above.

While the invention has been illustrated and described as embodied in an electrical connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrical connector for large-current circuits, comprising a longitudinally extending busbar having a pair of side edges extending between its ends; a clamping element of ferromagnetic material receiving a conductor to be connected to said busbar so that the electrical connector is a magnetically closed system; and a clamping organ, the improvement comprising said busbar having, at an end thereof to be connected to said conductor, a bend-over portion, bent to form a U-shaped part with one free end leg, said conductor having a free end laid immediately on the free end leg of said bend-over portion at a conductor plug-in side of the clamping member, said clamping member surrounding said free end leg of said bend-over portion including at least one of said side edges thereof with said free end of the conductor laid on said free end leg so that the clamping member abuts against said free end leg at a side thereof opposite to that on which said end of said conductor is laid, whereby current flowing through said conductor will emerge in said busbar exclusively at said plug-in side of said clamping element.

2. The connector as defined in claim 1, wherein said busbar has two ends each provided with such bend-over portion.

3. The connector as defined in claim 1, wherein said busbar, said clamping member, and said clamping organ are made of steel.

4. The connector as defined in claim 1, wherein said clamping organ is a clamping bolt inserted into said clamping member.

5. The connector as defined in claim 4, wherein said clamping means further include a pressing element, said bolt pressing said pressing element against the end of the conductor and the bend-over portion to connect them to each other.

* * * * *